US006319043B1

(12) United States Patent
Takatsuki et al.

(10) Patent No.: US 6,319,043 B1
(45) Date of Patent: Nov. 20, 2001

(54) CONNECTOR WITH LOCKING ARM HAVING GROOVE ON SURFACE FACING CONNECTOR HOUSING

(75) Inventors: Kozue Takatsuki; Masahiko Aoyama; Masahide Hio, all of Yokkaichi (JP)

(73) Assignee: Sumitomo Wiring Systems, Ltd. (JP)

( * ) Notice: Subject to any disclaimer, the term of this patent is extended or adjusted under 35 U.S.C. 154(b) by 0 days.

(21) Appl. No.: 09/649,294

(22) Filed: Aug. 28, 2000

(30) Foreign Application Priority Data

Aug. 31, 1999 (JP) ..... 11-245984

(51) Int. Cl.[7] ..... H01R 13/627
(52) U.S. Cl. ..... 439/358; 439/354
(58) Field of Search ..... 439/358, 357, 439/354, 353, 350, 351, 352

(56) References Cited

U.S. PATENT DOCUMENTS 5,775,932 * 7/1998 Saito et al. ..... 439/378
5,980,297 * 11/1999 Sugie ..... 439/354
6,116,939 * 9/2000 Fukuda ..... 439/354
6,129,593 * 10/2000 Aoyama et al. ..... 439/701
6,132,233 * 10/2000 Fukuda ..... 439/357

FOREIGN PATENT DOCUMENTS 1-112577 7/1989 (JP) .

* cited by examiner

*Primary Examiner*—Gary Paumen
*Assistant Examiner*—Ross Gushi
(74) *Attorney, Agent, or Firm*—Anthony J. Casella; Gerald E. Hespos

(57) ABSTRACT

A connector (A) has a connector housing (10) with an outer surface (10A). A locking arm (11) extends from the outer surface (10A). A groove (16) is formed on a base part (12) of the locking arm (11) along a direction in which the base part (12) is erected. A groove (18) is formed on an arm part (13) of the locking arm (11) along a direction in which the arm part (13) extends. The sectional configuration of the grooves (16, 18) include concave quadrantal curved surface (16R, 18R) that are smoothly continuous with each other. The formation of the grooves (16), (18) allow a stress to be dispersed to the entire locking arm (11). Thus, it is possible to reduce the strain to be applied to the base part (12) and prevent breakage of the base part (12).

12 Claims, 4 Drawing Sheets

CONNECTOR WITH LOCKING ARM HAVING GROOVE ON SURFACE FACING CONNECTOR HOUSING

BACKGROUND OF THE INVENTION

1. Field of the Invention

The present invention relates to a connector having a locking arm.

2. Description of the Related Art

A prior art connector that has a locking arm formed integrally with the outer surface of the connector housing is disclosed in Japanese Patent Application Laid-Open No. 1-112577. The locking arm of this prior art connector includes a base part that is erected from the outer surface of the connector housing. An arm part is cantilevered from the base part and extends along the outer surface of the connector housing. A locking projection is formed on the outer surface of the arm part, which is the surface that does not confront the outer surface of the connector housing. The connector can be fitted in a mating connector to achieve electrical connection. During this connection process, the locking projection interferes with a hood of the mating connector. As a result, the locking arm flexes elastically toward the outer surface of the connector housing. When both connectors are placed in the normal fit-in state, the locking arm is elastically restored to its original state, and the locking projection is locked to a locking hole in the hood. As a result, both connectors are locked to each other in the normal fit-in state.

Each prior art connector includes a connector housing that accommodates metal terminal fittings that are fixed to the ends of electric wires. A plurality of connectors with terminal fittings and wires is combined to produce a wire harness subassembly. Many of the wire harness subassemblies then are packed in a shipping case by piling them up one upon another for transport.

The prior art connector with a locking arm has a flexure space between the locking arm and the outer surface of the connector housing. The locking arm is cantilevered and extended over the connector housing, as explained above. Thus, there is a possibility that foreign matter will penetrate into the flexure space between the locking arm and the outer surface of the connector housing.

The wire harness subassemblies are taken out from the shipping case one by one in a place where they are assembled with other wires and connector housings to produce the wire harness. However, it is possible that an electric wire of another wire harness that is still in the shipping case may penetrate into the flexure space and may be caught by the locking arm. If the wire harness subassembly is to be forcibly taken out from the shipping case in this state, the locking arm of the connector caught by the electric wire is subjected to a force of forcibly displacing the locking arm in a direction away from the outer surface of the connector housing. Thus the locking arm tilts on the base part that acts as the supporting point.

In this event, in the conventional connector, there is a possibility that the locking arm is broken at its base part even if the displacement amount of the locking arm is not very great.

The present invention has been made in view of the above-described situation. Thus, it is an object of the present invention to provide a connector capable of preventing a locking arm displaced away from a connector housing from being easily broken.

SUMMARY OF THE INVENTION

To achieve the object, the present invention is directed to a connector having a connector housing and a locking arm formed integrally with an outer surface of the connector housing. The locking arm includes a base part erected from the outer surface of the connector housing. An arm part is cantilevered from the base part, and extends almost parallel with the outer surface of the connector housing. A flexure space is provided between the outer surface of the connector housing and an inner surface of the arm part to enable the arm part to flex elastically when the connector and a mating connector are locked to each other. In this construction, a groove is formed on a surface of the base part facing the flexure space and a groove is formed on a surface of the arm part facing the flexure space. The groove formed on the base part extends along a direction in which the base part is erected and the groove formed on the arm part extends along a direction in which the arm part is extended. A sectional configuration of the groove formed on the base part and that of the groove formed on the arm part includes a curve. Thus the grooves are smoothly continuous with each other.

One likely reason for the locking arm to be broken at its base part when the locking arm tilts away from the outer surface of the connector housing is that a stress concentrates on the base part and the degree of strain of the base part is greater than that of other portions.

Thus, in the present invention, the grooves are formed on the base part and the arm part, respectively. Therefore, the stress generated by the tilting of the locking arm is dispersed to the locking arm almost entirely, and the amount of strain in the base part is reduced, which prevents the base part from being broken. The surface of the base part and that of the arm part on which the grooves are formed, respectively face the flexure space, thus receiving a tensile load when the locking arm tilts. Therefore, there is a fear that both sides of the groove will crack. However, according to the present invention, the sectional configuration of the groove formed on the base part and that of the groove formed on the arm part include a curve, and the curves are smoothly continuous with each other. Accordingly, it is possible to relax the convergent application of the stress to the groove, and to prevent the generation of cracks on both sides of the groove.

DETAILED DESCRIPTION OF THE PREFERRED EMBODIMENTS

A connector according to a first embodiment of the present invention will be described below with reference to FIGS. 1–6.

Figure 1:
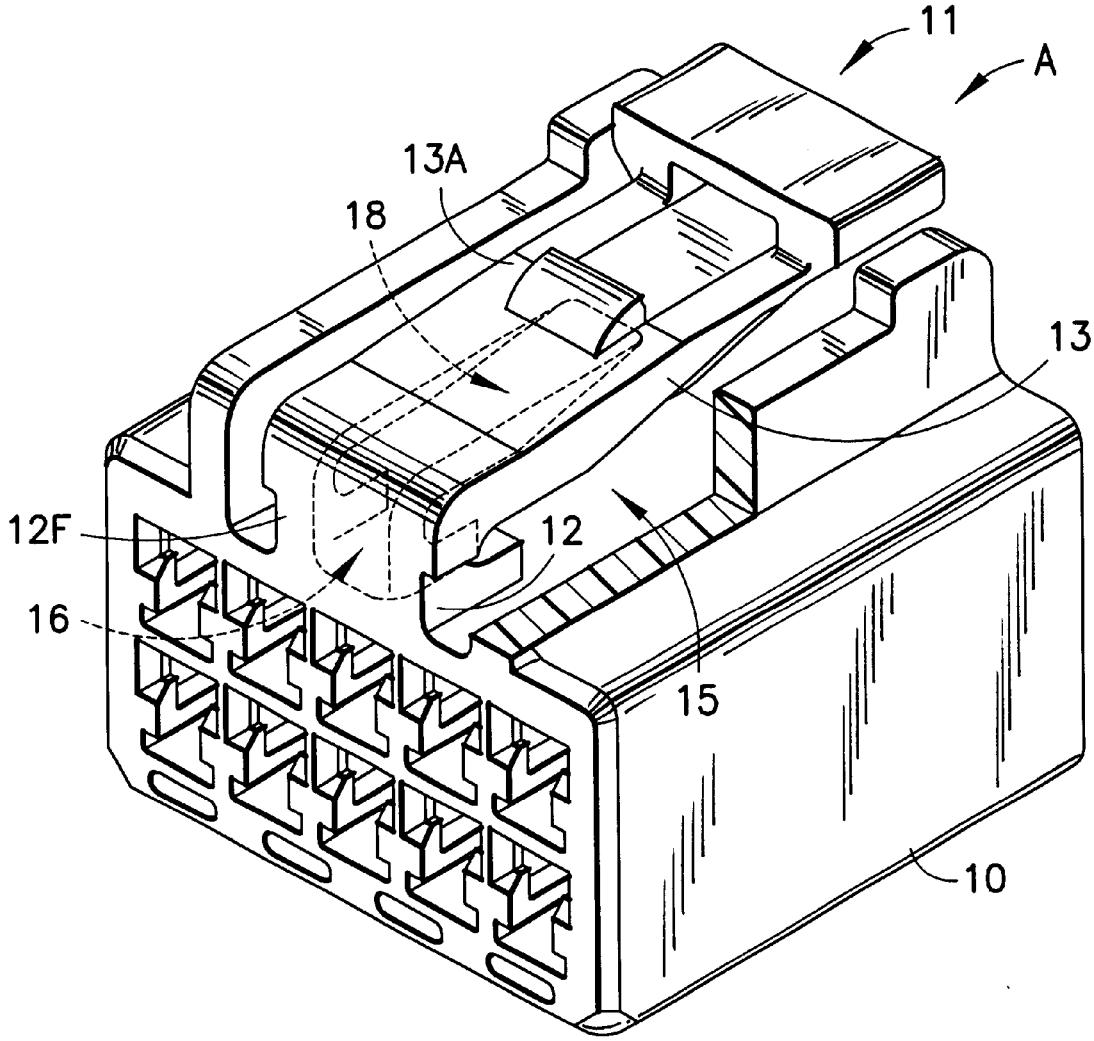
FIG. 1 is a perspective view showing a connector of a first embodiment of the present invention.
Figure 2:
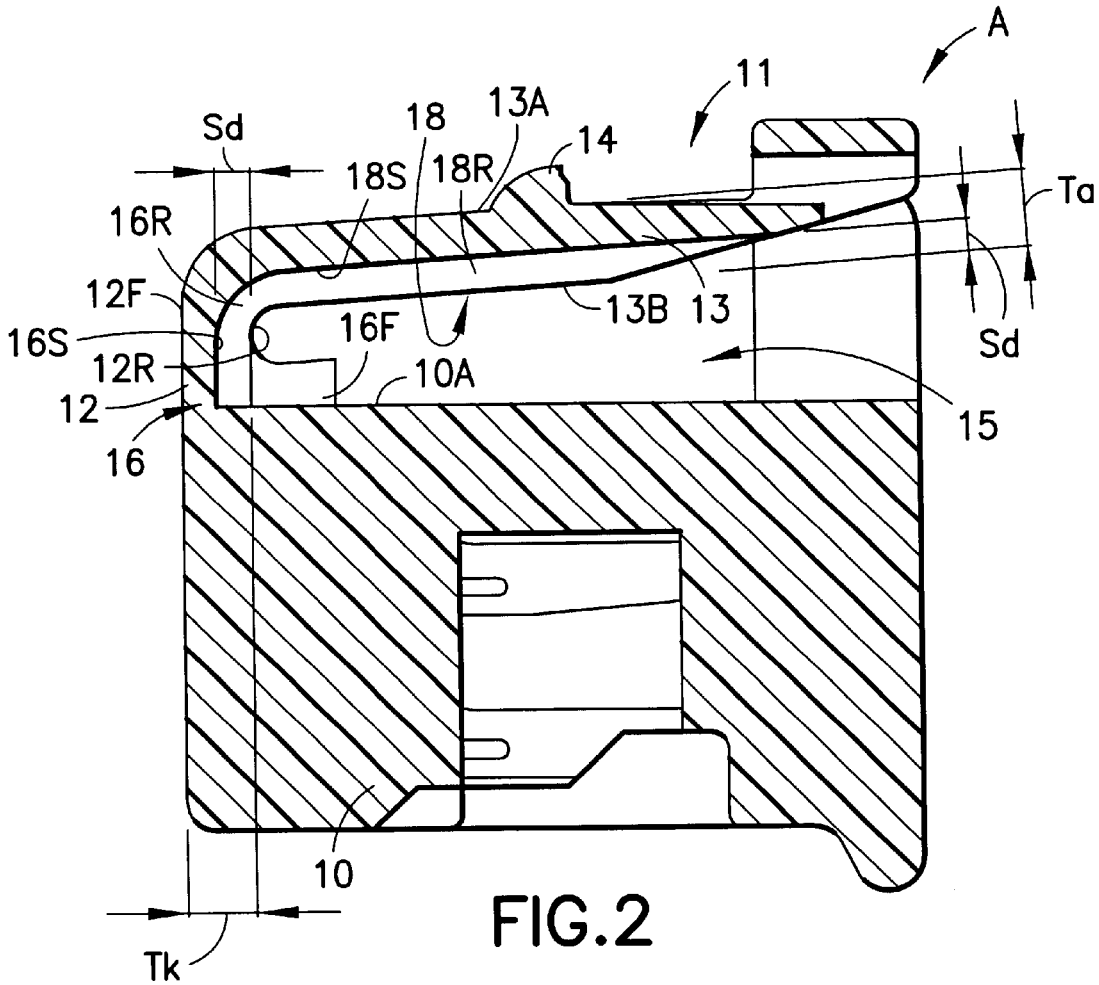
FIG. 2 is a longitudinal sectional view showing the connector.
Figure 4:
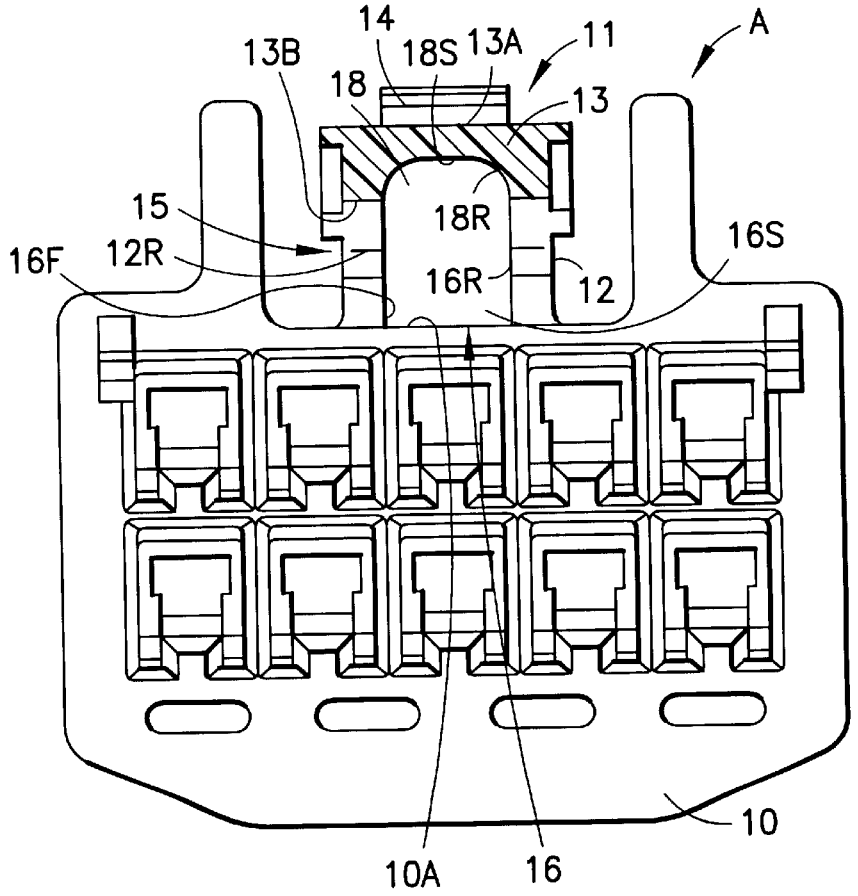
FIG. 4 is a rear view showing the connector in a state in which a locking arm is broken away.
Figure 5:
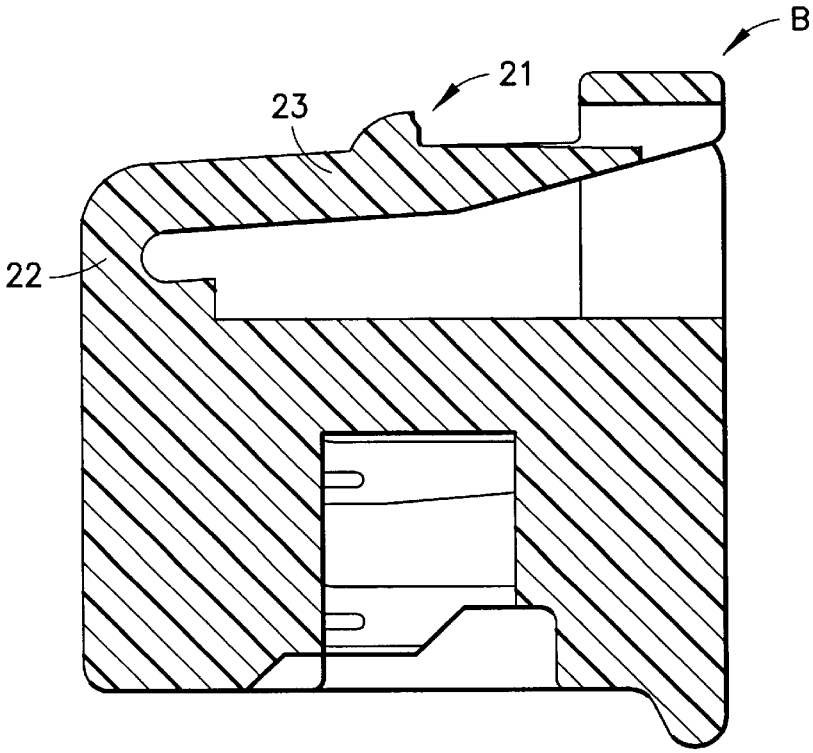
FIG.5 PRIOR ART
FIG. 5 is a sectional view showing a conventional connector.

A connector in accordance with a first embodiment of the invention is identified by the letter A in FIGS. 1, 2 and 4. The connector A a connector housing made of PBT, and a locking arm 11 is formed integrally with an outer surface of the connector housing 10. The locking arm 11 includes a base part 12 erected from a front end of an outer surface 10A of the connector housing 10. An arm part 13 is cantilevered from the upper end of the base part 12 and extends rearwardly along the outer surface 10A of the connector housing 10. A locking projection 14 is formed on an outer surface 13A of the arm part 13, which is the surface that does not confront the outer surface 10A of the connector housing 10. A flexure space 15 is provided for elastically flexing the arm part 13. More particularly, the flexure space 15 is provided between an inner surface 13B of the arm part 13, which is the surface facing the flexure space, and the outer surface 10A of the connector housing 10.

During the process of fitting the connector A and a mating connector (not shown) in each other, the locking projection 14 interferes with an inner peripheral surface of a hood of the mating connector. As a result, the locking arm 11 flexes elastically such that the arm part 13 tilts on the base part 12 acting as the supporting point of the tilting motion of the arm part 13 and approaches the outer surface 10A of the connector housing 10. When both connectors are placed in a normal fit-in state, the locking arm 11 is restored elastically to its original state, and the locking projection 14 is locked to a locking hole (not shown) of the hood. As a result, both connectors are locked to each other in the normal fit-in state.

In the connector A of the first embodiment, metal terminal fittings (not shown) are fixed to ends of electric wires (not shown). The terminal fittings are inserted into the connector housing 10 from the rear. The connector A is combined with other connectors and wires to produce a wire harness subassembly. Then, several wire harness subassemblies are packed in a shipping case for transport. One wire harness subassembly is taken out from the shipping case in a wire harness-assembling place. At this time, there is a possibility that an electric wire of another wire harness subassembly will penetrate into the flexure space 15 between the connector housing 10 and the locking arm 11, and will be caught by the arm part 13. If the wire harness subassembly is to be forcibly taken out from the shipping case in this state, the locking arm 11 caught by the electric wire is subjected to a force of forcibly displacing the locking arm 11 in an upward direction or away from the outer surface 10A of the connector housing 10, with the locking arm 11 tilting upward on the base part 12 acting as the supporting point. In this event, in the conventional connector, there is a possibility that the locking arm is broken at its base part, even though the displacement amount of the locking arm is not very great. However, in the first embodiment, the connector is constructed so that the locking arm 11 can be prevented from being easily broken. The construction of the locking arm 11 will be described in detail below.

A front surface 12F of the base part 12 of the locking arm 11 is continuous and flush with the front surface of the connector housing 10. The base part 12 also has a rear surface 12R that faces the flexure space 15. The rear surface 12R of the base part 12 is a substantially semicylindrical arc-shaped surface that is substantially continuous with both the inner surface 13B of the arm part 13 and the outer surface 10A of the connector housing 10. The semicylindrical arc-shaped surface is generated about an axis that is substantially parallel to the outer surface 10A and extending in a side-to-side direction. Thus, the inner surface 13B of the arm part 13 is substantially tangent to the circular arc-shaped surface 12R.

The smallest thickness Tk of the longitudinal thickness dimensions between the front surface 12F of the base part 12 and the semicylindrical arc-shaped surface 12R (rear surface) thereof is set almost equal to the vertical thickness Ta of a front region of the arm part 13 located forward from the locking projection 14 and near the base part 12.

A vertical groove 16 is formed on the rear surface 12R of the base part 12 facing the flexure space 15 such that the groove 16 is positioned in the center of the base part 12 in its widthwise direction. The groove 16 extends along the extension direction of the base part 12 erected from the connector housing 10. The rear surface 12R on which the groove 16 is formed receives a tensile load, when the locking arm 11 is displaced away from the connector housing 10, i.e., when the locking arm 11 tilts upward.

A groove 18 is formed on the inner surface 13B of the arm part 13 facing the flexure space 15 such that the groove 18 is positioned in the center of the arm part 13 in its widthwise direction. The groove 18 extends along the extension direction (front-to-back direction) of the arm part 13 and is continuous with the groove 16.

The configuration of each of the grooves 16, 18 is described below.

Figure 3:
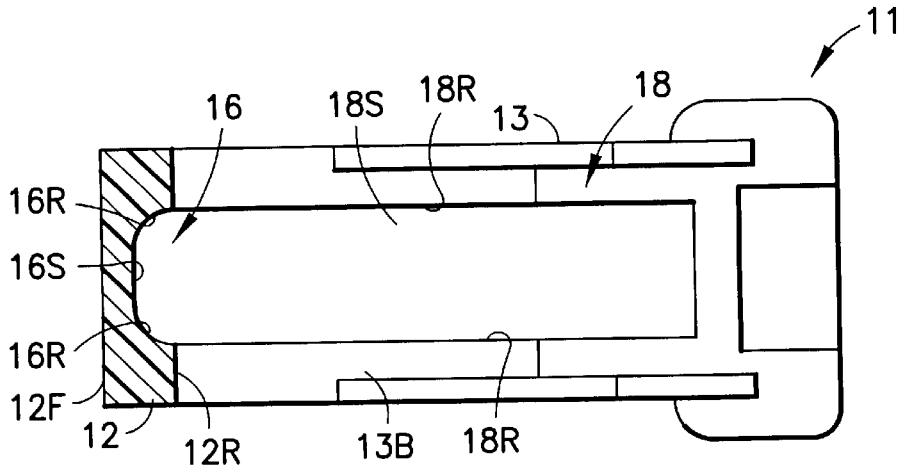
FIG. 3 is a sectional view taken along a line 3—3 of FIG. 2.

The rear surface 12R of the base part 12 is a substantially cylindrically generated arc-shape generated an axis extending in a horizontal, side-to-side direction, whereas a bottom surface 16S of the groove 16 is flat and almost parallel with the front surface 12F of the base part 12. The bottom surface 16S is linear in a top-to-bottom direction, when it is viewed sectionally, as shown in FIG. 2, and is linear in a side-to-side direction, as show in FIG. 3. Quadrantal surfaces 16R define the left and right inner side surfaces of the groove 16. More particularly, the quadrantal surfaces 16R each define one-quarter of a cylindrical surface generated about a vertical axis that is substantially parallel to the front surface 12F. Thus the quadrantal surfaces 16R are continuous tangential extensions of the flat bottom surface 16S. The quadrantal surfaces 16R also extend rearwardly to the semicylindrical arc-shaped rear surface 12R and intersect the rear surface 12R approximately at right angles, as shown in FIG. 3. Parallel flat continuous surfaces 16F are perpendicularly adjacent the outer surface 10A of the housing 10 and extend almost perpendicular to the bottom surface 16S. The flat surfaces 16F also extend tangentially and smoothly continuous in a rearwardly direction from the quadrantal surface 16R as shown in FIGS. 2 and 4. Furthermore, the flat surfaces 16F intersect the semicylindrical rear surface 12R at right angles.

A ceiling surface 18S formed on the groove 18 of the arm part 13 is flat and almost parallel with the outer surface 13A of the arm part 13. Both sides of the ceiling surface 18S are smoothly and tangentially continuous with quadrantal surfaces 18R, each of which is a quarter of a cylindrical surface generated about an axis that is parallel to the extension of the arm part 13. The quadrantal surfaces 18R intersect the inner surface 13B of the arm part 13 at right angles. Furthermore, the quadrantal surfaces 18R intersect with the quadrantal surface 16R at substantially right angles to define spherically generated concave surfaces.

The radius of the quadrantal surface 16R of the groove 16 and that of the quadrantal surface 18R of the groove 18 are equal to each other. Accordingly, the shallowest portion of the groove 16 and the depth of the groove 18 have the same dimension Sd, which is about ½ of the smallest thickness Tk and the vertical thickness Ta. The width of the groove 16 and that of the groove 18 are equal to each other, and the widthwise location of the groove 16 and that of the groove 18 are coincident with each other. The bottom surface 16S of the groove 16 is smoothly continuous with the ceiling surface 18S of the groove 18, and the quadrantal surfaces 16R and 18R are smoothly continuous with each other.

The operation of the first embodiment is described below.

As explained above, the locking arm 11 can be subjected to a force for displacing the locking arm 11 upward from the connector housing 10. This force will cause the locking arm 11 to tilt on the base part 12, and the base part acts as the supporting point of the tilting motion of the locking arm 11. It is conceivable that stress concentrates on the base part. If the degree of strain of the prior base part is too great, then the prior art locking arm can be broken at the base part.

According to the first embodiment, the grooves 16 and 18 are formed on the base part 12 and the arm part 13, respectively. Thus, the stress generated by the tilting of the locking arm 11 is dispersed to the locking arm 11 almost entirely, and the degree of the strain of the base part 12 is reduced, which prevents the base part 12 from being broken.

The surface of the base part 12 and that of the arm part 13 on which the grooves 16 and 18 are formed, face the flexure space 15, and thus receive a tensile load when the locking arm 11 tilts. Therefore, there is a fear that a rib-shaped portion, of the base part 12, located at both sides of the groove 16 may crack. However, according to the first embodiment, the inner surfaces of the grooves 16 and 18 include the quadrantal surfaces 16R and 18R, respectively and are smoothly continuous with each other. The smooth continuous quadrantal surfaces 16R and 18R allow the stress to be dispersedly applied to the base part 12 to a high extent.

As a result, it is possible to prevent the generation of cracks at a tilting angle of about 45 degrees. At a tilting angle of about 45 degrees, an electric wire caught by the locking arm 11 slides on the inner surface 13B of the arm part 13 and can be separated therefrom. The locking arm 11 that is not cracked at a tilting angle of not more than about 45 degrees is considered to be very practical and can be used.

It is possible to prevent the stress from being applied convergently to the rear surface of the base part 12 because the rear surface of the base part 12, continuous with the inner surface 13B of the arm part 13, is formed as the cylindrically generated arc-shaped surface 12R having the uniform curvature.

As described above, in the first embodiment, it is possible to disperse the stress applied to the locking arm 11 to a high degree. That is, it is possible to prevent the stress from being applied convergently to the base part 12 and thus to prevent the base part 12 from being broken.

Further, to investigate the function of the locking arm 11 of the connector A of the first embodiment, the locking arm 11 was displaced rotationally by a large angle of about 180 degrees. This 180° displacement of course, is much greater than any displacement that would be likely to occur in response to a wire being caught under the locking arm 11. Despite this extreme displacement of about 180°, only minor cracks were observed in the rib-shaped portions where the base part 12 and the arm part 13 meet, located at both sides of the groove 16 . The base part 12 did not break and no part of the locking arm 11 separated from the connector housing 10. The locking arm 11 was restored resiliently to its original posture. As a result, the locking arm 11 kept the original posture and was locked to a locking projection of a mating connector, thus displaying its function.

Figure 6:
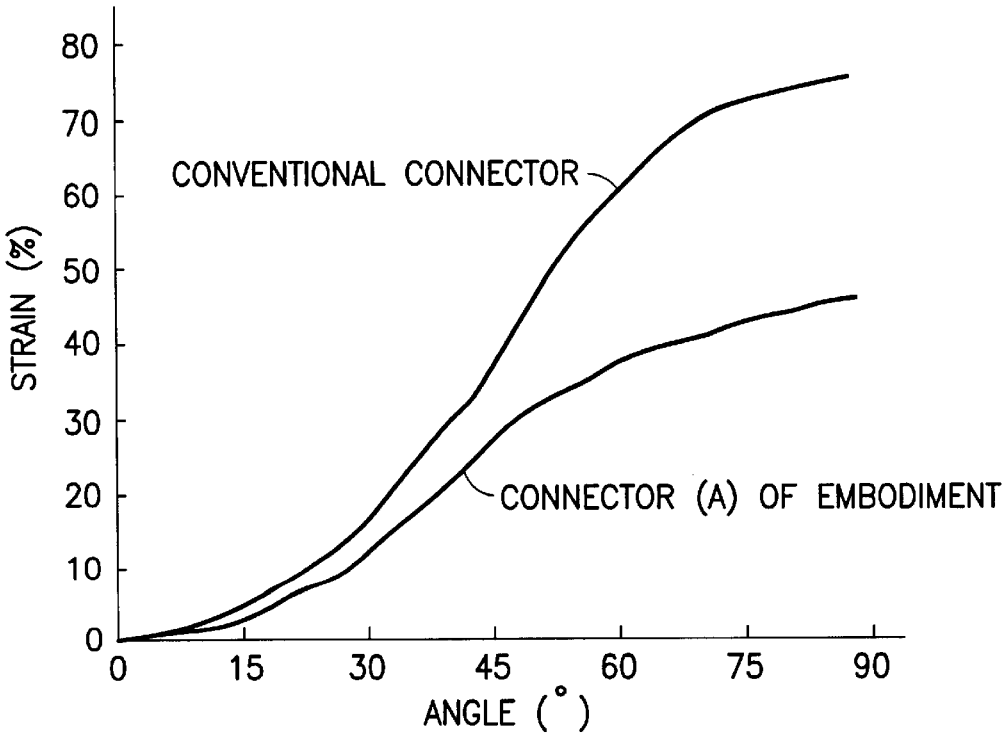
FIG. 6 is a graph showing the relationship between an angle of tilting made by an arm part with a base part acting as a supporting point and a maximum strain of a locking arm.

FIG. 6 shows a graph indicating the result of tests conducted on the connector housing A, made of PBT, of the first embodiment and a conventional connector B (shown in FIG. 5) made of PBT. The tests were conducted on the connector housing A to investigate the correlation between the angle of tilting made by the arm part 13, with the base part 12 acting as the supporting point of the tilting motion of the arm part 13 and the maximum strain of the locking arm 11 (base part 12). The tests also were conducted on the conventional connector housing B to investigate the correlation between the angle of tilting made by an arm part 23, with a base part 22 acting as the supporting point of tilting made by the arm part 23 and the maximum strain of a locking arm 21 (base part 22). In the conventional connector B, the thickness of the base part 22 was almost equal to that of the arm part 23. Further, a groove was not formed on the base part 22 and the arm part 23. The graph indicates that supposing that the tilting angle of the arm part 13 is equal to that of the arm part 23, the maximum strain value of the connector A of the first embodiment is smaller than that of the conventional connector B. The test result indicates that the locking arm 11 of the connector A of the first embodiment has a stress dispersion degree higher than that of the locking arm 21 of the conventional connector B.

The present invention is not limited to the embodiment explained by way of the above description and drawings. For example, the following embodiments are included in the technical scope of the present invention. Further, various modifications can be made without departing from the spirit and scope of the present invention.

In the preferred embodiment, the depth of the shallowest portion of the groove of the base part and that of the groove of the arm part are about ½ of the thickness of the base part and the arm part. But according to the present invention, the relationship between the depth of the groove and the thickness of the base part and the arm part can be set and altered as desired.

In the preferred embodiment, the depth of the shallowest portion of the groove of the base part is set equal to that of the groove of the arm part. But according to the present invention, both depths may be different from each other.

In the preferred embodiment, the curve constituting the sectional configuration of the groove is a quadrantal surface having a uniform curvature (uniform diameter). But according to the present invention, the sectional configuration of the groove may be constituted of a curve whose curvature varies.

In the preferred embodiment, the sectional configuration of the groove includes a straight line. But according to the present invention, the sectional configuration of the groove may consist of a curve whose curvature is uniform or varies.

What is claimed is:

1. A connector (A) having a connector housing (10) and a locking arm (11) formed integrally with an outer surface (10A) of said connector housing (10), said locking arm (11) including a base part (12) erected from said outer surface (10A) of said connector housing (10); an arm part (13) cantilevered and extended from said base part (12) substantially parallel with said outer surface (10A) of said connector housing (10); and a flexure space (15) provided between said outer surface (10A) of said connector housing (10) and an inner surface (13B) of said arm part (13), to enable elastic flexing of said arm part (13) when said connector (A) and a mating connector are locked to each other, wherein a groove (16) is formed on a surface (12R) of said base part (12) facing said flexure space (15) and a groove (18) is formed on a surface (13B) of said arm part (13) facing said flexure space (15) such that said groove (16) formed on said base part (12) extends along a direction in which said base part (12) is erected and said groove (18) formed on the arm part (13) extends along a direction in which said arm part (13) is extended; and a sectional configuration of said groove (16) formed on said base part (12) and that of said groove (18) formed on said arm part (13) include a curve and are smoothly continuous with each other.

2. The connector (A) of claim 1, wherein a portion of the base part (12) where said groove (16) is formed defines a thickness of about one half the thickness of the base part (12) adjacent said groove (16).

3. The connector (A) of claim 2, wherein a portion of the arm part (13) where said groove (18) is formed defines a thickness of about one half the thickness of the arm part (13) adjacent the groove (18).

4. The connector (A) of claim 1, wherein the base part (12) has a rear surface (12R) formed as a substantially cylindrically generated arc.

5. The connector (A) of claim 4, wherein the cylindrically generated arc defining the rear surface (12R) of the base part (12) is substantially tangent with an inner surface (13B) of the arm part (13).

6. The connector (A) of claim 1, wherein the groove (16) in the base part (12) includes a pair of concave quadrantal curved surfaces (16R) on opposite lateral sides of said base part (12) and said quadrantal curved surfaces (16R) being generated about axes extending upwardly from said outer surface (10A) of the connector housing (10).

7. The connector (A) of claim 6, wherein the groove (18) in the arm part (13) includes a pair of concave quadrantal curved surfaces (18R) formed at opposite respective sides of said groove (18) in said arm part (13) and said quadrantal curved surfaces (18R) of said arm part (13) being generated about axes extending substantially parallel to the arm part (13), the quadrantal curved surfaces (18R) in the groove (18) of the arm part (13) extending continuously into the quadrantal curved surfaces (16R) in the grooves (16) of the base part (12) to define substantially spherically generated concave surfaces.

8. A connector (A) having a connector housing (10) with opposed front and rear ends, an outer surface (10A) extending between the front and rear ends of the connector housing (10), a locking arm (11) including a base part (12) erected from said outer surface (10A) adjacent the front end of said connector housing (10), an arm part (13) cantilevered from said base part (12) and extending toward the rear end of said connector housing (10) substantially parallel with the outer surface (10A) such that a flexure space (15) is defined between said outer surface (10A) of said connector housing (10) and said arm part (13) to enable elastic flexing of said arm part (13), a groove (16) being formed in a face (12R) of said base part (12) facing said flexure space (15) and a groove (18) being formed in the face (13B) of said arm part (13) facing said flexure space (15), the grooves (16, 18) extending through a continuous curve from the base part (12) to the arm part (13).

9. The connector (A) of claim 8, wherein faces (12R, 13B) of said base part (12) and said arm part (13) facing said flexure space (15) intersect at a continuous concave cylindrically generated surface.

10. The connector (A) of claim 9, wherein the grooves (16, 18) each have concave quadrantal curved surfaces (16R, 18R) along lateral sides of said grooves (16, 18), said quadrantal curved surfaces (16R, 18R) being generated about axes extending substantially parallel to said respective grooves (16, 18).

11. The connector (A) of claim 8, wherein portions of the base part (12) having the groove (16) define a thickness measured along a front to rear direction approximately one-half the thickness of the base part (12) at locations spaced from the groove (16).

12. The connector (A) of claim 11, wherein portions of the arm part (13) having the groove (18) define a thickness measured perpendicular to the outer surface (10A) that is approximately one-half the thickness defined by said arm part (13) at locations adjacent to said groove (18).

* * * * *